US009482027B2

(12) United States Patent
Mallookis et al.

(10) Patent No.: US 9,482,027 B2
(45) **Date of Patent: *Nov. 1, 2016**

(54) MECHANISMS FOR SHELTER ATTACHMENTS

(71) Applicant: Go Papa, LLLP, Littleton, CO (US)

(72) Inventors: Steven E. Mallookis, Littleton, CO (US); Steven B. Mallookis, Littleton, CO (US); Chao-Shun Ko, Taipei (TW)

(73) Assignee: Go Papa, LLLP, Littleton, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/973,997

(22) Filed: Dec. 18, 2015

(65) Prior Publication Data

US 2016/0186457 A1 Jun. 30, 2016

Related U.S. Application Data

(63) Continuation of application No. 13/660,169, filed on Oct. 25, 2012, now Pat. No. 9,234,366.

(51) Int. Cl.

| | |
|---|---|
| ***E04H 15/64*** | (2006.01) |
| ***E04H 15/54*** | (2006.01) |
| ***E04H 15/50*** | (2006.01) |
| ***E04H 15/44*** | (2006.01) |

(52) U.S. Cl.

CPC ..... *E04H 15/64* (2013.01); *E04H 15/44* (2013.01); *E04H 15/50* (2013.01); *E04H 15/54* (2013.01)

(58) Field of Classification Search

CPC ..... E04H 15/54; E04H 15/64; E04H 15/50
See application file for complete search history.

(56) References Cited

U.S. PATENT DOCUMENTS

| | | | | |
|---|---|---|---|---|
| 1,666,757 | A * | 4/1928 | Snyder | E04H 15/28 135/116 |
| 1,884,449 | A | 10/1932 | Wickstrum | |
| 2,137,625 | A | 11/1938 | Norvell | |
| 4,641,676 | A | 2/1987 | Lynch | |
| 4,941,500 | A | 7/1990 | Emard | |
| 4,947,884 | A | 8/1990 | Lynch | |
| 5,490,532 | A | 2/1996 | Mallookis et al. | |
| 5,634,483 | A | 6/1997 | Gwin | |
| 8,132,584 | B2 | 3/2012 | Lane et al. | |
| 8,316,508 | B2 | 11/2012 | Lapping | |
| 2002/0104561 | A1 | 8/2002 | Carter | |
| 2005/0205124 | A1 | 9/2005 | Goldwitz | |
| 2006/0096631 | A1 | 5/2006 | Mallookis et al. | |

(Continued)

*Primary Examiner* — David R Dunn
*Assistant Examiner* — Danielle Jackson
(74) *Attorney, Agent, or Firm* — Brooks, Cameron & Huebsch, PLLC

(57) ABSTRACT

A shelter includes a number of vertical support legs, and a mounting member coupled to vertical support legs. A collapsible truss section interconnects the vertical support legs to support a canopy. At least one buckle mechanism comprising a first releasably engageable body and a second releasably engageable body. The first releasably engageable body is attached to the collapsible truss section and is configured to receive the second releasably engageable body attached to the canopy thereby coupling the canopy to the collapsible truss section. Additional examples include a cable that spans between an adjacent pair of vertical support legs around a periphery of the shelter. The cable is seated within the channel of the mounting member. At least one curtain coupled to the cable by a releasably engageable fastener. The fastener is slidable along the cable to facilitate movement of the curtain.

19 Claims, 12 Drawing Sheets

(56) References Cited

U.S. PATENT DOCUMENTS

| | | | |
|---|---|---|---|
| 2006/0118155 | A1 | 6/2006 | Carter |
| 2007/0251562 | A1 | 11/2007 | Carter |
| 2009/0056781 | A1 | 3/2009 | Stanley et al. |
| 2009/0250089 | A1 | 10/2009 | Carter |
| 2010/0180923 | A1 | 7/2010 | Carter |
| 2011/0048483 | A1 | 3/2011 | Carter |
| 2011/0232712 | A1 | 9/2011 | Carter |
| 2012/0211041 | A1 | 8/2012 | Carter |
| 2013/0061896 | A1 | 3/2013 | Webster |

* cited by examiner

MECHANISMS FOR SHELTER ATTACHMENTS

PRIORITY INFORMATION

This application is a Continuation of U.S. application Ser. No. 13/660,169 filed Oct. 25, 2012, the specification of which is incorporated herein by reference.

FIELD OF THE INVENTION

The present invention relates generally to a collapsible shelter, and more particularly to a mechanism for rigid adjustable attachment of a canopy to a collapsible shelter and a collapsible curtain system for such a shelter.

BACKGROUND OF THE INVENTION

Portable collapsible shelters, e.g., folding canopies, are in widespread use. These shelters are common at beaches, sporting events, farmers markets, weddings, graduations and other outdoor and indoor events. Collapsible shelters may provide portable, easily erectable, and durable shelters for varied purposes.

Portable collapsible shelters can include accordion-type collapsible truss assemblies between supporting legs of the shelter. Accordion-type collapsible truss assemblies can include a number of truss members interconnected at pivotal x-joints near truss member midpoints and at pivotal v-joints near truss member endpoints. The truss members may be connected at one endpoint to a portion of a shelter leg, e.g., at a slidable or fixed mounting bracket, and at another endpoint to another truss member at a pivotal v-joint. Thus, the accordion-type collapsible truss assembly can be expanded and collapsed to allow for ease of transport, setup, and takedown.

Truss assemblies for portable collapsible shelters were previously composed of thick walled steel tubing, or solid piping. To increase portability of collapsible shelters, some manufacturers have used lighter weight and lower strength materials, e.g., aluminum for example, in truss assemblies of collapsible shelters. To limit weight and cost, some manufacturers have also used thin walled truss members in portable collapsible assemblies. Manufacturers continue to incorporate canopies of varying designs and varied attachments in to their portable collapsible shelters.

DETAILED DESCRIPTION

Figure 1A:
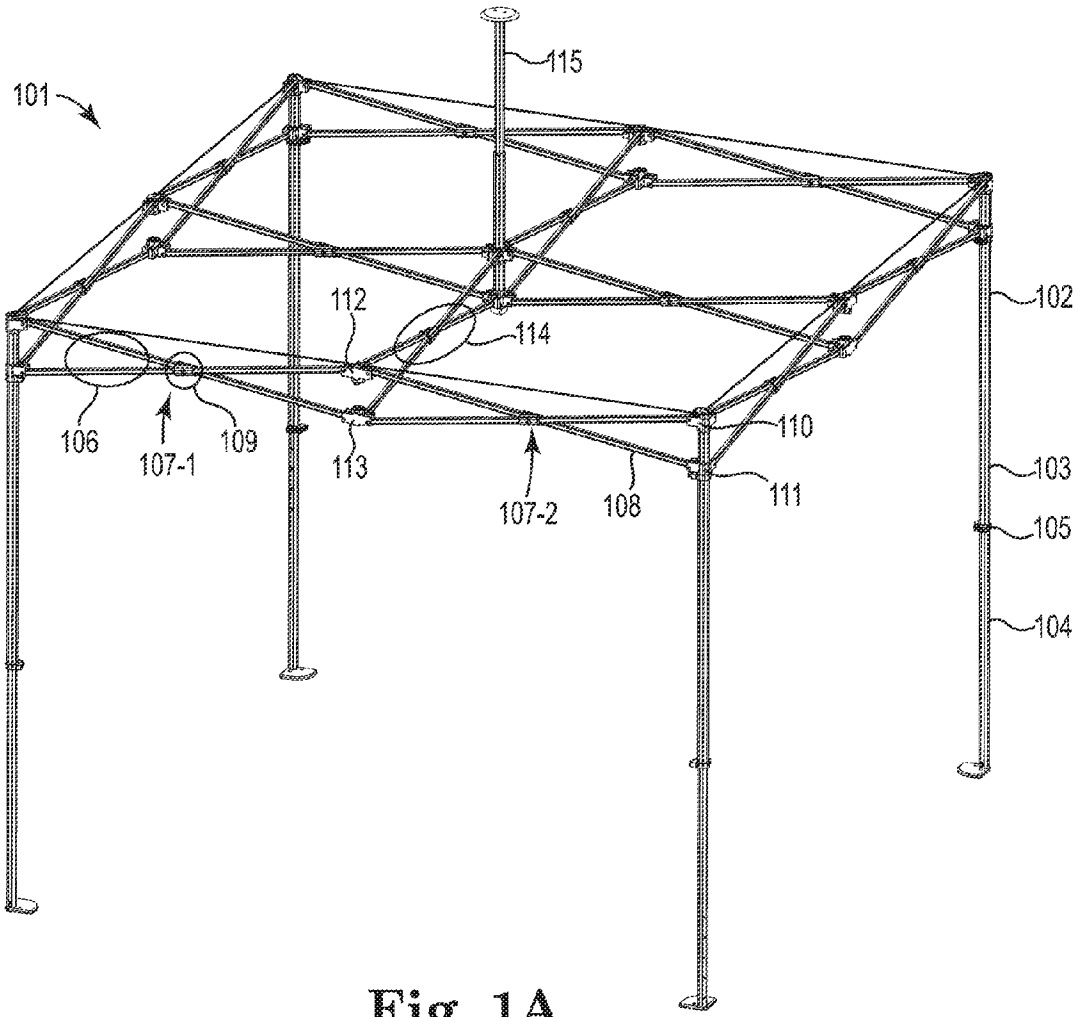
FIG. 1A illustrates a perspective view of a collapsible shelter according to an embodiment of the present disclosure.

The present disclosure includes a collapsible shelter with a collapsible curtain system and a mechanism of removably attaching a canopy to the shelter. A number of embodiments include a shelter with a number of vertical support legs, a mounting member coupled to a vertical support leg, a collapsible truss section interconnecting vertical support legs, wherein the number of vertical support legs and the collapsible truss section are configured to support a canopy, and a buckle mechanism comprising a first releasably engageable body configured to receive a second releasably engageable body attached to a canopy, wherein the first releasably engageable body is attached to the collapsible truss section.

The buckle mechanism of the number of embodiments provides a releasably engageable attachment between the canopy and the truss section of the collapsible shelter. The releasability of the canopy allows users to remove the canopy if and when they choose. This allows users the flexibility of easily switching out canopies, removing the canopy during storage or transport, or removing the canopy for ease of cleaning or repair.

Additionally, the buckle mechanism of the number of embodiments provides rigid adjustable attachment when it is engaged. Embodiments of the disclosed buckle mechanism differ from hook and loop fasteners, e.g., Velcro® attachments, which easily release when force is applied (i.e. wind) and lose effectiveness when they come in contact with debris and moisture. The buckle mechanism of the disclosed embodiments provides reliable attachment under all environmental conditions and does not release without physical human interaction and actuation of a component.

Embodiments of the disclosed buckle mechanism are different from fixed snaps or grommets which are not adjustable in use, post manufacturing. That is, the buckle mechanism of the number of embodiments allows the user to adjust the tension between the canopy and the underlying truss system. In some embodiments, this is accomplished by attaching the second engageable body to the canopy through an adjustable strip of fabric having an end sewn to the canopy. The result is an adjustable system which allows the user to tailor the fit of the canopy to the specific architecture, tolerance variations, and wear changes of a collapsible shelter. For instance, the user can tighten the canopy to avoid destructive water pocketing, e.g. from rain, or slack areas which act as wind catches. Furthermore, with normal use a canopy may stretch over time and the buckle mechanism of the number of embodiments allows users to adjust canopy tautness to remove any resulting slack by tightening the fit of the canopy through adjustments to the buckle mechanism. Additionally, the buckle mechanism of the number of embodiments allows the user to loosen the fit if so desired. Due to differences in canopy size and shape inherent to the canopy manufacturing process, every canopy may offer a slightly different fit to the collapsible truss section of a collapsible shelter. Additionally, differing weather conditions may cause a particular canopy to exhibit differing elastic properties causing a slightly different fit to the collapsible truss section of a collapsible shelter. The buckle mechanism, by allowing the user to loosen the fit between the canopy and the underlying collapsible truss section, may alleviate the forces associated with too tight of a fit and prevent warping and failure of the collapsible truss section associated with these strains.

The buckle mechanism of the number of embodiments provides ease of use and is more forgiving of tolerance variations in the manufacture process of canopy tops than grommet and snap mechanisms. Unlike grommet and snap mechanisms of attachment between canopies and collapsible truss sections, the disclosed embodiments permit manufacturers to attach, e.g. via sewn attachment, a strap to a canopy and position a second releasably engageable body of a buckle mechanism with less precision. The adjustable buckle mechanism of this disclosure allows the user to influence the fit of the canopy after manufacture to account for variability in attachment placement and shape/dimensions of the canopy inherent in the canopy manufacture process.

In one embodiment, when the canopy is in place, the second releasably engageable body's attachment to the canopy is tucked away from sight. This configuration provides the collapsible shelter a clean, finished appearance inside and out. Having the second releasably engageable body's attachment to the canopy tucked away prevents users from becoming entangled in the attachment and prevents inadvertent release associated with any such entanglement.

In a number of embodiments, the shelter includes a number of vertical support legs and a number of mounting members coupled to the number of vertical support legs. The number of mounting members include a channel configured to receive a cable. A number of collapsible truss sections interconnects the number of vertical support legs and a cable spans between the number of vertical support legs around a periphery of the shelter. The cable can be seated within the channel of each mounting member. A number of curtains can be coupled to the cable via releasably engageable fasteners. The fasteners can be slidable along the cable to move the number of curtains.

The curtain mechanism can provide the user with a number of configuration options for the collapsible shelter, and additionally allow rapid transition between these configurations with ease of effort. The curtain mechanism offers the ability to slide curtains into numerous positions, to couple and uncouple the curtains, and to tie the curtains back to the shelter legs providing the user the ability to not only change the aesthetics of the collapsible shelter, but to adapt the shelter to any environmental conditions (i.e. wind, precipitation, cold, heat, privacy, etc.). Furthermore, because the curtain mechanism can be coupled to the collapsible truss sections, it, too, can collapse with the collapsible shelter to a portable conformation such that the curtain mechanism does not need to be installed and uninstalled with every use. Moreover, the attachment of the cable of the curtain mechanism to the collapsible truss section allows for the cable to remain attached to the collapsible truss sections, maintain a tension in the mechanism when the shelter is erect, and avoid interference with the other functions associated with the collapsible truss sections (e.g. the ability to collapse the mounting member and truss sections, attach and remove connections to the canopy, position corner tensioner members (discussed in association with FIG. 5A), etc.).

In the following detailed description of the present disclosure, reference is made to the accompanying drawings that form a part hereof, and in which is shown by way of illustration how a number of embodiments of the disclosure may be practiced. These embodiments are described in sufficient detail to enable those of ordinary skill in the art to practice the embodiments of this disclosure, and it is to be understood that other embodiments may be utilized and that structural changes may be made without departing from the scope of the present disclosure. As used herein, "a number of" something can refer to one or more of such things. For example, a number of vertical support legs can refer to one or more vertical support legs.

FIG. 1A illustrates a perspective view of a collapsible shelter according to an embodiment of the present disclosure. There is shown in FIG. 1A a form of collapsible shelter broadly comprised of a collapsible frame assembly 101. The collapsible frame assembly 101 has four vertical support legs 102 at spaced peripheral intervals. In a number of embodiments, the collapsible frame can have any number of vertical support legs at spaced peripheral intervals. Each vertical support leg 102 can have an upper and lower telescoping members 103 and 104 which can be connected with an adjustable locking member 105 to regulate a length of extension. In a number of embodiments, the vertical support legs can be of any suitably shaped cross-section and can be comprised of any number of telescoping members. In some embodiments, the vertical support legs may also incorporate other mechanisms of extension and collapse (e.g. folding, detachable assembly, etc.). As depicted, the frame assembly 101 has outer peripheral truss sections 106 made up of two pair, e.g. 107-1 and 107-2, of upper and lower scissors-like pivotal truss arm members 108, each pair interconnected at pivotal x-joints 109. The truss sections are connected in end-to-end relation to one another by upper and lower intermediate mounting members 112 and 113 between adjacent upper and lower corner mounting members 110 and 111 attached to vertical support legs 102 of the frame. Radial truss sections 114 extend between ends of the truss members 108 attached to a center support tube 115 and ends of the truss arm members 108 attached the upper and lower intermediate mounting members 112 and 113 of each outer peripheral truss section 106, respectively. In other embodiments, the frame assembly 101 and peripheral truss sections 106 may include other collapsible architectures, e.g. geodesic domes, grid shell structures, cathedral style structures, marquee structures, etc., as the same will be understood by those of skill in the art.

Figure 1B:
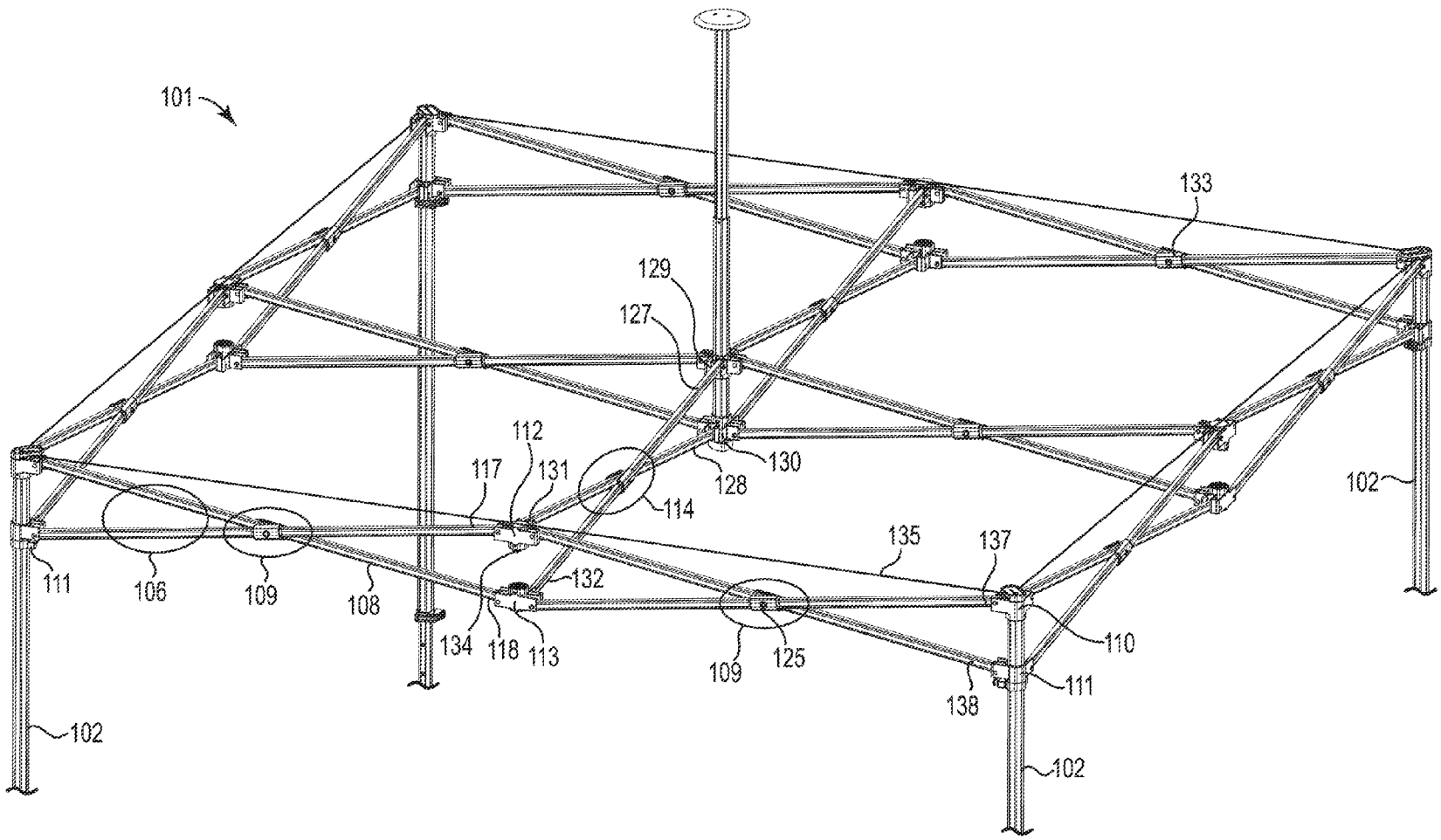
FIG. 1B illustrates a perspective view of the upper portion of a collapsible frame assembly according to an embodiment of the present disclosure.

FIG. 1B illustrates a perspective view of the upper portion of a collapsible frame assembly 101 (shown in FIG. 1A) of an embodiment of the present disclosure. FIG. 1B illustrates central upper terminal and central lower terminal ends 117 and 118 of the truss arm members 108 of the outer peripheral truss sections 106 connected to the upper and lower intermediate mounting members 112 and 113 of each outer peripheral truss section 106. Each corner upper terminal end 137 of the outer peripheral truss sections 106 is depicted as attached to an upper corner mounting member 110 and each corner lower terminal end 138 is attached by a lower corner mounting member 111 (e.g., a slider mount) to the corner support legs 102, as shown in FIG. 1B. The slider mounts 111 can be released in such embodiments to permit collapse of the frame assembly 101 into a compact folded state. During collapse of such an embodiment, the pivotal x-joints 109, depicted in FIG. 1B with a connecting member 125, for example a bolt, passing through an aperture at a longitudinal midpoint in each of the two truss arm members 108 associated with the pivotal x-joint 109, allow the truss arm members 108 to pivot with respect to each other and collapse the frame assembly 116 like an accordion as the slider mounts 111 move downward. The radial truss sections 114 have inner upper and lower ends 127 and 128 of the truss arm members 108 attached to upper and lower center mounting members 129 and 130, respectively, and outer upper and lower ends 131 and 132 attached to the upper and lower intermediate mounting members 112 and 113, respectively, of each outer peripheral truss section 106 as shown in FIG. 1B.

Additionally, the embodiment in FIG. 1B shows a layered u-bracket 133 as the connecting member according to an embodiment of the invention. Described in more detail below in association with FIG. 1C, the layered u-brackets 133 are depicted positioned at the pivotal x-joints 109 providing reinforcement for the pivotal x-joints 109. In a number of embodiments, the layered u-brackets may be present at any number of locations where reinforcement would be structurally advantageous.

As shown in FIG. 1B, the upper intermediate mounting member 112 includes an attached first releasably engageable body 134. As described in more detail in connection with FIG. 2 and FIG. 3, the first releasably engageable body 134 comprises the female portion of a buckle mechanism. In other embodiments, the first releasably engageable body may comprise the male portion of a buckle mechanism. Additionally, in a number of embodiments, the first releasably engageable bodies may be attached to the lower intermediate mounting members or another suitable surface on the shelter frame (e.g. attached to an upper corner mounting member, a slider mount, or along another portion of the peripheral truss sections or vertical support legs themselves).

The embodiment depicted in FIG. 1B shows a cable 135 spanning between the number of vertical support legs 102 around the periphery of the collapsible frame assembly 101. In at least one embodiment the cable 135 is seated within channels, not visible in FIG. 1B but depicted in greater detail in FIGS. 5A and 5B, of each upper corner mounting member 110. In other embodiments, channels to receive a cable may be present at the upper intermediate mounting members. In yet other embodiments, channels to receive a cable may be present or attached along locations of the peripheral truss sections or vertical support legs of the shelter. The frame assembly 101 embodiments illustrated in FIGS. 1A and 1B are configured to receive a canopy, as described in further detail in association with FIG. 2.

Figure 1C:
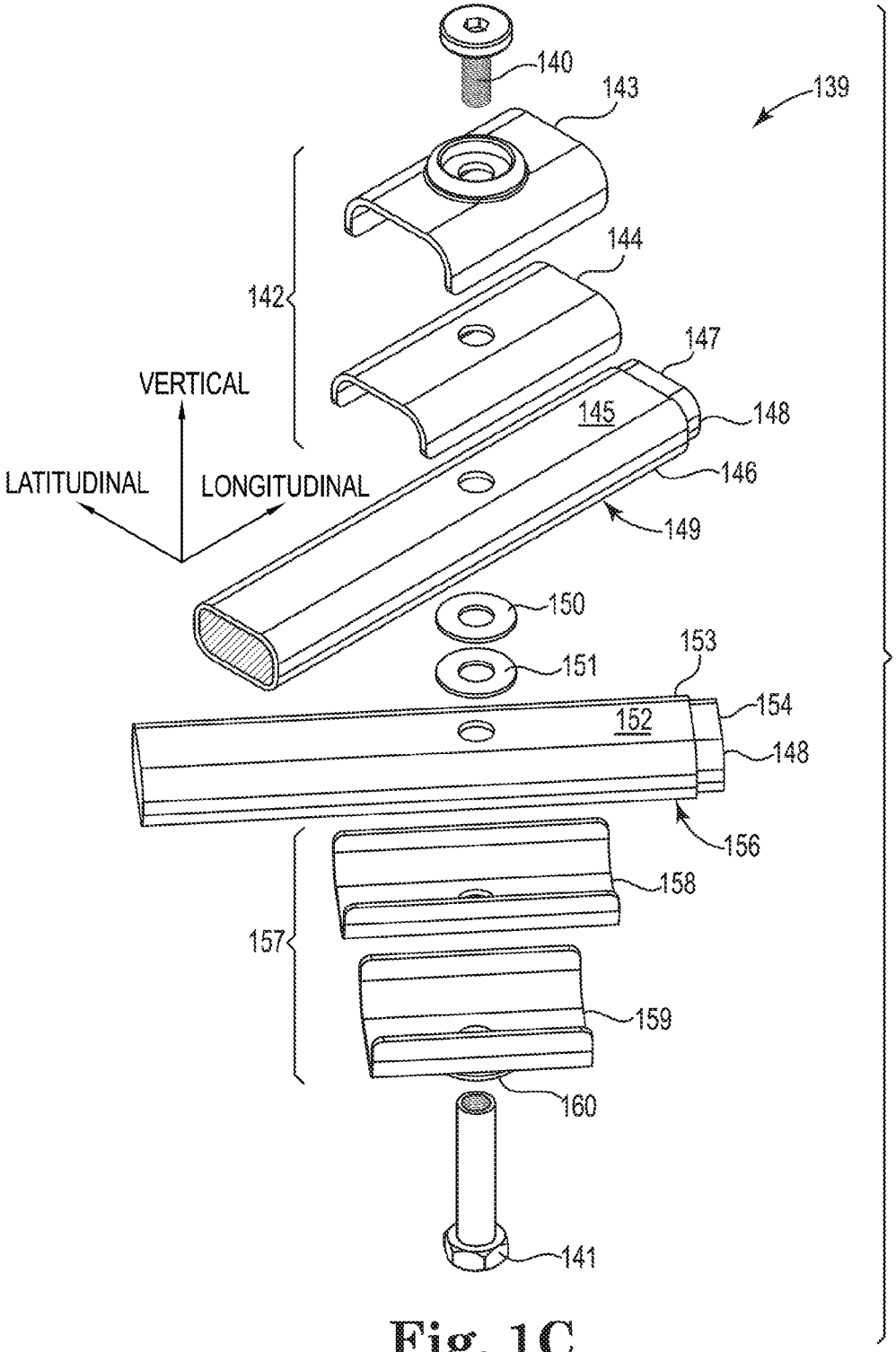
FIG. 1C is an exploded view of a layered u-bracket as a connecting member to a pivotal x-joint according to an embodiment of the present disclosure.

FIG. 1C illustrates an exploded view of a layered u-bracket 142 and 157 (133 of FIG. 1B) as a connecting member to the pivotal x-joint 139 according to an embodiment of the present disclosure. As described above, the pivotal x-joint 139 can be at a longitudinal midpoint of each truss member, e.g., peripheral truss sections 106 and radial truss sections 114 of FIGS. 1A and 1B, associated with the x-joint 139, e.g., where two arm members 148 cross. The x-joint 139 can allow pivoting of each arm member 148 of a truss section through rotation about a connecting member placed through the aligned apertures in the various components associated with the pivotal x-joint 139. For example, a connecting member can include a bolt 140 and a non-compression sleeve 141. The bolt 140 can pass through, in order: a first layered u-bracket 142 from second u-bracket 143 to first u-bracket 144; a first wall 145 of a first arm member 146 of a truss section (not visible); a first internal support body 147; a second wall 149 of a first arm member 146 of a truss section (not visible); one or more washers, e.g., washers 150 and 151; a first wall 152 of a second arm member 153 of a truss section (not visible); a second internal support body 154; a second wall 156 of the second arm member 153 of a truss section (not visible); and a second layered u-bracket 157 from first u-bracket 158 to second u-bracket 159 and be received and attached to a non-compression sleeve 141.

One or more embodiments of the present disclosure can include layered u-brackets, 142 and 157, on both longitudinal sides of arm members 148 of a truss section, e.g., on first wall 145 and second wall 149 of first arm member 146 of a truss section. Such a layered u-bracket may be provided with or without an annulus portion 160. For example, one truss member could include a layered u-bracket flush with a first longitudinal wall and having an annulus portion, and a second layered u-bracket flush with a second longitudinal wall and not having an annulus portion. Such embodiments can be useful in providing additional strength at a corresponding pivotal joint.

A portion of the connecting member can be secured by a nut or a polygonal head, e.g., of a non-compression sleeve 141, which can be housed within an annulus portion 160 of a layered u-bracket, e.g., layered u-bracket 157. In some embodiments, the connecting member can be formed from steel, or another material. Other forms of connecting members can be used with embodiments of the present disclosure, as will be understood by one of ordinary skill in the art. The one or more washers, e.g., washers 150 and 151, placed between arm members 146 and 153 at the pivotal x-joint 139 can be formed of a lightweight material that allows the members to pivot with relatively little friction, e.g., nylon.

Figure 2:
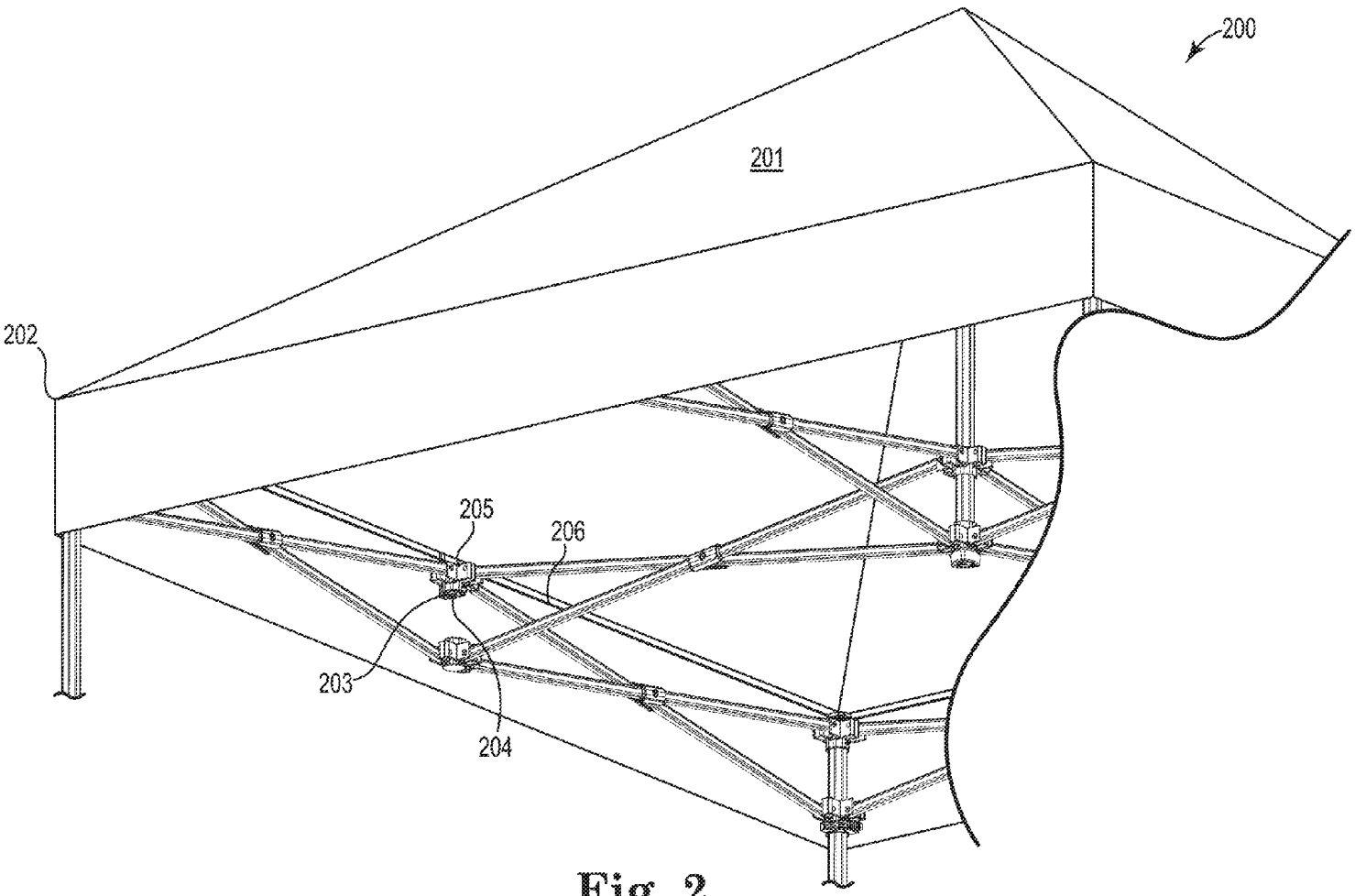
FIG. 2 illustrates a perspective view of a shelter including a buckle mechanism according to an embodiment of the present disclosure.

FIG. 2 illustrates a perspective view of a shelter 200 including a buckle mechanism according to an embodiment of the present disclosure. In the embodiment illustrated in FIG. 2, a canopy 201, typically of canvas or polyester composition and of a generally polygonal configuration with four corners 202 is shown. Also present is a first releasably engageable body 204, depicted as the female end of a buckle mechanism, attached to an upper intermediate mounting member 205. In a number of embodiments, the first releasably engageable body may comprise any engageable body (i.e. the male portion of a buckle mechanism). A second releasably engageable body 203 is shown attached (details of such an attachment are described in relation to FIG. 3) to the canopy 201. In the depicted embodiment the second releasably engageable body 203 is the male end of a buckle mechanism. In a number of embodiments, the second releasably engageable body may comprise any engageable body (i.e. the female portion of a buckle mechanism). The second releasably engageable body 203 of FIG. 2 is depicted in releasable engagement with a first releasably engageable body 204. The second releasably engageable body can be attached to the canopy at any position allowing it sufficient proximity to a first releasably engageable body when the shelter is erect. The attachment of the second releasably engageable body to the canopy can be affected a multitude of ways including hook and loop fasteners, snaps, grommets, clips, adhesives, ties, etc., or may be affected using the mechanisms described in association with FIG. 3. In the embodiment illustrated in FIG. 2, a cable 206, described in greater detail in association with FIGS. 4A and 4B, is suspended above an upper intermediate mounting member 205 running parallel to a seam in the canopy 201.

Figure 3:
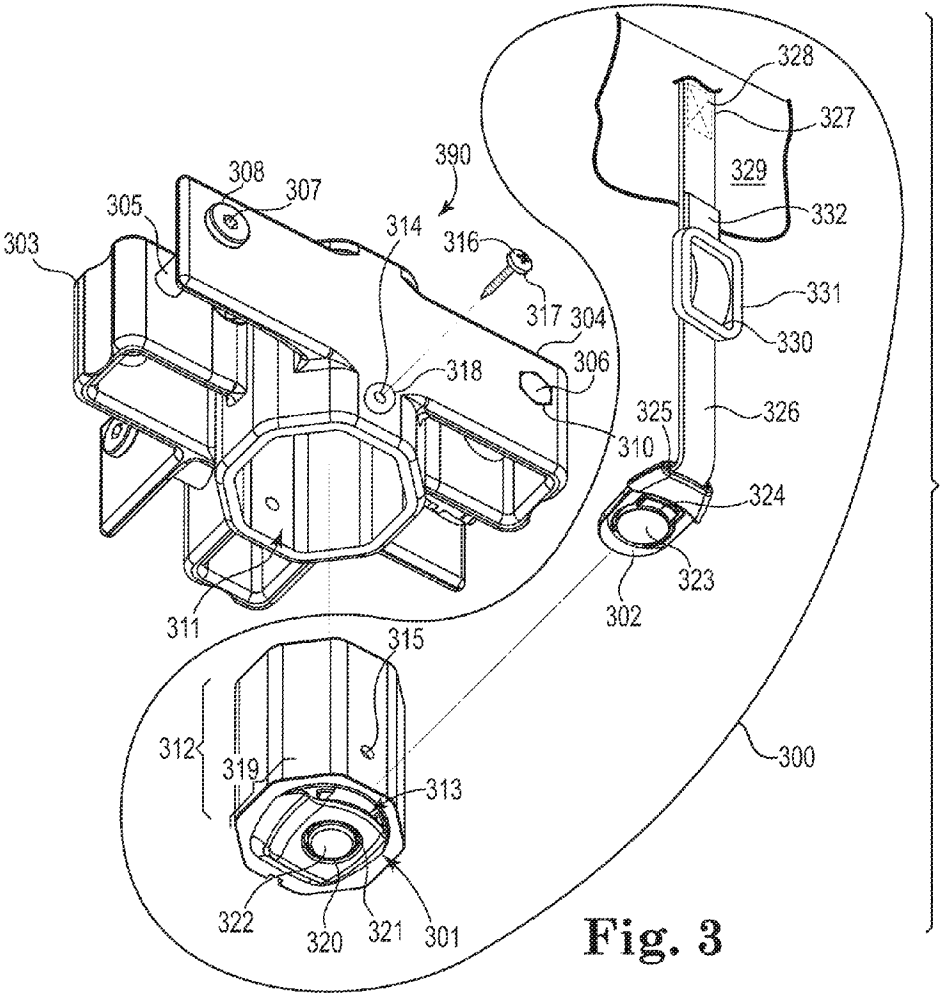
FIG. 3 illustrates an exploded view of an intermediate mounting member and a buckle mechanism of a collapsible shelter according to an embodiment of the present disclosure.
Figure 4A:
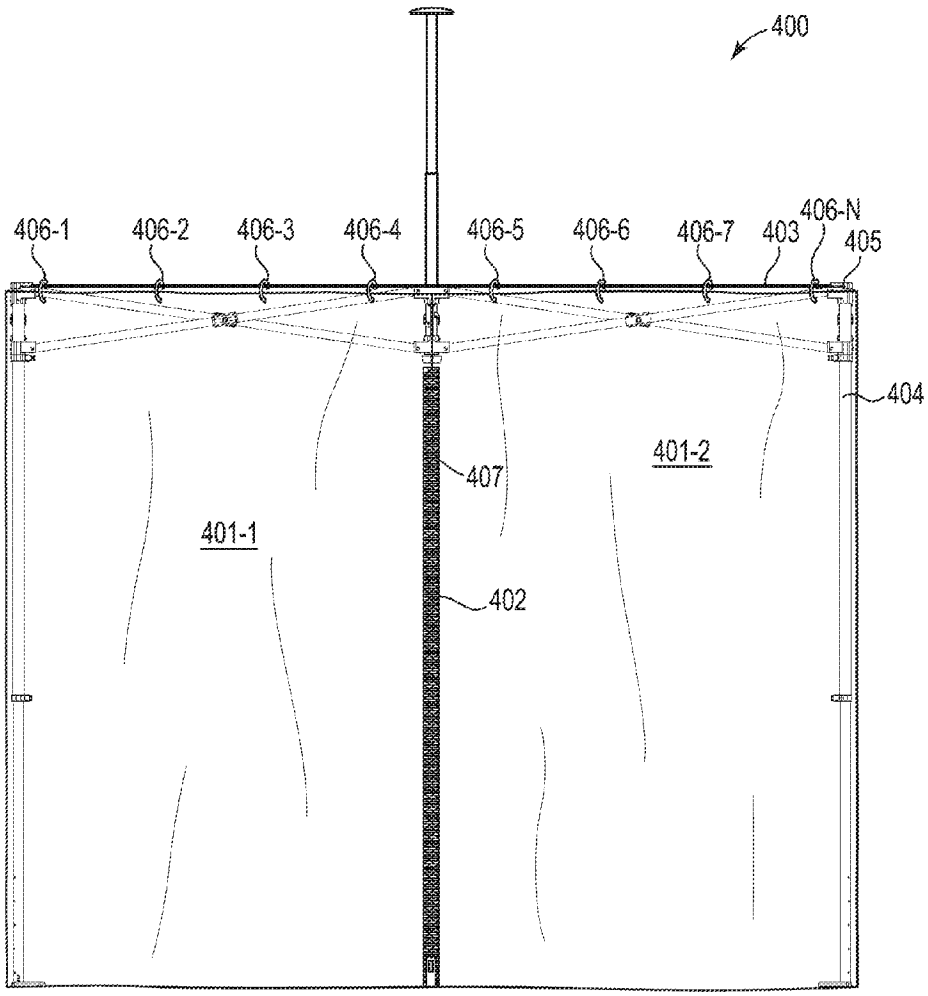
FIG. 4A is a side view of a collapsible shelter including two curtains suspended along its periphery and releasably coupled with a zipper according to an embodiment of the present disclosure.
Figure 4B:
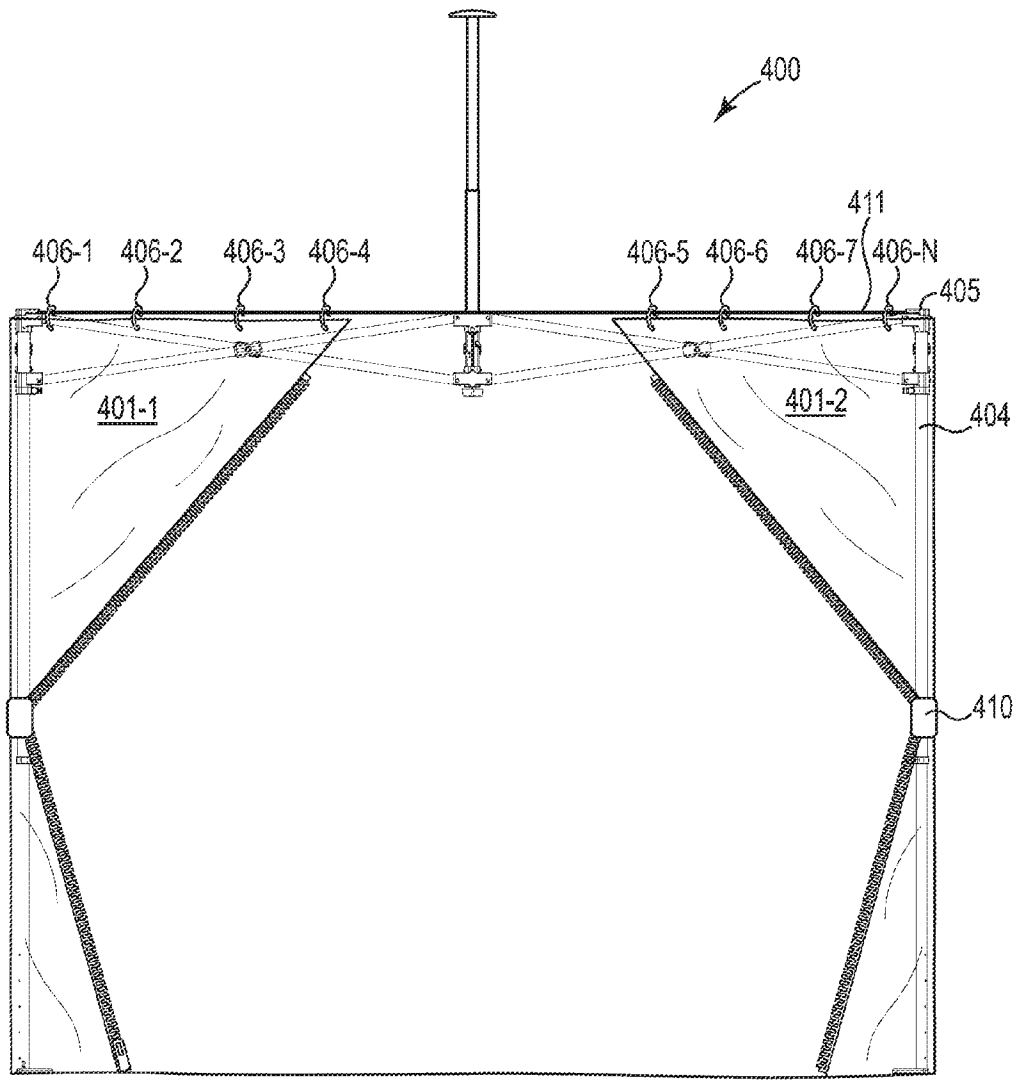
FIG. 4B is a side view of a shelter including curtains releasably fixed in a drawn position and curtain tie backs according to an embodiment of the present disclosure.

FIG. 3 illustrates an exploded view of an intermediate mounting assembly 390 and a buckle mechanism 300 of a collapsible shelter according to an embodiment of the present disclosure. FIG. 3 provides the upper intermediate mounting member 390, a first releasably engageable body 301 of a buckle mechanism 300 and a second releasably engageable body 302 of a buckle mechanism 300. The upper intermediate mounting member 390 is preferably made up of a polypropylene compound and includes bosses 303 in the form of generally lateral projections 304 which receive hollow pivot shafts 305 having a noncircular head 306 to threadedly receive a bolt 307 having an enlarged head 308 for pivotally securing the terminal ends of the arm members to the bosses 303 for pivotal movement about horizontal axes with a minimum of pressure and frictional engagement therebetween. The pivot shaft 305 which is preferably metal is inserted through an aligned bore in the arm members (not shown), and an aligned bore in the boss 303 until the non-circular head 306 is seated in a conforming stop or recess (not visible in FIG. 3 because the space is occupied by the non-circular head 306 of a pivot shaft). The non-circular head 306 of a pivot shaft 305 is fixed against rotation in the conforming recess (not visible) and the bolt 307 is threaded into an internally threaded end of the hollow shaft 305. This allows for greater ease of use by a user as tightening or replacing the bolt 307 requires a single wrench and one-handed operation.

The upper intermediate mounting member 390 of FIG. 3 includes an opening 311. The opening may be any suitable shape, but the depicted embodiment shows an octagonal prism shaped opening 311 in the upper intermediate mounting member 390 configured to receive a first releasably engageable body 301 having a corresponding shape, in this case that of an octagonal prism. In the embodiment of FIG. 3, it can therefore be understood that the octagonal prism forms a male end 312 of the first releasably engageable body 301 which engages a female end 311 of the upper intermediate mounting member 390 comprising the octagonal prism shaped cavity. Therefore, FIG. 3 demonstrates that a first releasably engageable body 301 may have, on the same body, both a male portion 312 and a female portion comprising an insert groove 313 of a first releasably engageable body 301 configured to accept a second releasably engageable body 302. Further depicted in FIG. 3 is a bore 314 in the body of the upper intermediate mounting member 390. A matching bore 315 is present in the octagonal prism shaped first releasably engageable body 301. The octagonal prism shaped first releasably engageable body 301 of the embodiment of FIG. 3 may be attached to the upper intermediate mounting member 390 of this embodiment by inserting the octagonal prism shaped first releasably engageable body 301 into the octagonal prism shaped opening 311 in the upper intermediate mounting member 390, aligning the bores 314 and 315 of the two pieces, and threading a screw 316 into the two bores 314 and 315, tightening until the screw head 317 is seated in a conforming stop or recess 318.

In the embodiment depicted in FIG. 3, when the first releasably engageable body 301 is attached to the upper intermediate mounting member 390 the portion 319 of the first releasably engageable body 301, which is configured to engage the second releasably engageable body 302, is exposed. The exposed portion 319, in this embodiment, comprises an insert groove 313 configured to receive the second releasably engageable body 302. Additionally, this embodiment includes a circular opening 320 having a retaining lip 321 about its periphery. Positioned within the circular opening 320, a resilient pressing arm 322 is situated such that it may, upon actuation, be depressed into the circular opening 320. Embodiments, however, are not limited to the geometry described.

In FIG. 3, the second releasably engageable body 302 is shown as a substantially flat member configured to fit within the insert groove 313 of the first releasably engageable body 301 configured to receive it. In the central portion of the second releasably engageable body 302, a resilient retaining plate 323 is positioned having a raised lip 324 extending above the flat plane of the second releasably engageable body 302. The resilient retaining plate 323 of the second releasably engageable body 302 is shaped such that it may engage its raised lip 324 with the retaining lip 321 of circular opening 320 of the first releasably engageable body 301 to affect releasable engagement. As the second releasably engageable body 302 is inserted into the insert groove 313 of the first releasably engageable body 301, the resilient retaining plate 323 of the second releasably engageable body 302 and its raised lip 324 are depressed by the interior walls of the insert groove 313 of the first releasably engageable body 301 such that the raised lip 324 no longer extends above the flat plane of the second releasably engageable body 302 and the second releasably engageable body 302 is allowed to slide within the insert groove 313 of the first releasably engageable body 301. Once the second releasably engageable body 302 proceeds far enough in to the first releasably engageable body 301, the resilient retaining plate 323 of the second releasably engageable body 302 fully reaches the circular opening 320 of the first releasably engageable body 301 and the force depressing the resilient retaining plate 323 is dissipated such that the resilient retaining plate 323 of the second releasably engageable body 302 is no longer fully depressed and the raised lip 324 extending above the flat plane of the second releasably engageable body 302 engages the retaining lip 321 affecting releasable engagement. When the user (not shown) wishes to disengage the first releasably engageable body 301 from the second releasably engageable body 302, the user actuates the resilient pressing arm 322 of the first releasably engageable body 301 causing it to enter the circular opening 320 of the first releasably engageable body 301 and displace the resilient retaining plate 323 of the second releasably engageable body 302. With the resilient retaining plate 323 depressed, the raised lip 324 of the resilient retaining plate 323 no longer engages the retaining lip 321 of the circular opening 320 of the first releasably engageable body 301 and the user can pull the second releasably engageable body 302 from the first releasably engageable body 301.

The embodiment illustrated in FIG. 3 includes a fabric channel 325 conforming to a strip of fabric 326 associated with the second releasably engageable body 302. Through the fabric channel 325, a strip of fabric 326 is positioned. At one terminus 327, the strip of fabric 326 can be sewn to a canopy 329, e.g., canopy 201 of FIG. 2. At another terminus 332, the strip of fabric 326 can be looped back through an opening 330 of a slide adjuster 331 positioned on the strip of fabric 326. In this configuration, the strip of fabric 326 can be adjusted within the channel 330 of the slide adjuster 331 to provide adjustable tension between a canopy 329 and the first releasably engageable 301 of the buckle mechanism 300 attached, for example, to an upper intermediate mounting member 300.

FIG. 4A is a side view of a collapsible shelter 400 including two curtains 401-1 and 401-2 suspended along a periphery of a collapsible frame assembly, e.g., 101 in FIG. 1, and releasably coupled together with a coupling mechanism 402 according to an embodiment of the present disclosure. The shelter 400 of the embodiment depicted in FIG. 4A includes a cable 403 spanning between the number of vertical support legs 404 along the periphery of the shelter 400, wherein the cable 403 is seated within the channels, not shown here, but shown in greater detail in FIGS. 5A and 5B, of each corner mounting member 405. FIG. 4A includes a number of curtains, e.g., 401-1 and 401-2, depicted here as a transparent material, releasably coupled to a cable 403. In this embodiment, the number of curtains 401-1 and 401-2 are releasably coupled to the cable 403 via slidable fasteners 406-1, . . . , 406-N. In some embodiments, the fasteners that couple the curtains to the cable may comprise hooks, loops, carabineers, spring clips, or any other fastener that will provide slideable attachment. In one embodiment, the curtain is attached to a spring clip fastener by a strip of fabric, attached to the curtain at both of its termini, positioned within a channel of the spring clip. In such an embodiment, the spring clips are slideable along a cable allowing the user (not shown) to draw or close the curtains. Additionally, FIG. 4A shows an embodiment wherein the curtains 401-1 and 401-2 are releasably coupled together along a vertical edge 407. In the depicted embodiment, the curtains 401-1 and 401-2 are releasably coupled with a coupling mechanism 402, e.g., a zipper, along a vertical edge 407. When the curtains 401-1 and 401-2 are releasably coupled, in the depicted embodiment in the zipped configuration, the curtains 401-1 and 401-2 will remain releasably fixed in the closed position, resistant to outside elements.

FIG. 4B is a side view of a collapsible shelter 400 including curtains, 401-1 and 401-2 releasably fixed in a drawn position, and curtain tie backs 410 according to an embodiment of the present disclosure. FIG. 4B includes a cable 411 spanning between the number of vertical support legs 404 around the periphery of the collapsible shelter 400, wherein the cable 411 is seated within the channels, not visible here, but shown in greater detail in FIGS. 5A and 5B, of each corner mounting member 405. FIG. 4B includes a number of curtains 401-1 and 401-2 releasably coupled to the cable 411. In this embodiment, the number of curtains 401-1 and 401-2 are releasably coupled to the cable 411 via slideable fasteners 406-1, . . . , 406-N. The slideable fasteners 406-1, . . . , 406-N are slideable along the cable 411 allowing the user (not shown) to draw or close the curtains 401-1 and 401-2. FIG. 4B shows the curtains 401-1 and 401-2 in a drawn configuration. FIG. 4B additionally features curtain tie backs 410 which gatherer their respective curtain, e.g., 401-1 or 401-2, at one of the vertical support legs 404. When the curtains 401-1 and 401-2 are gathered to vertical support legs 404, the curtains 401-1 and 401-2 will remain releasably fixed in the drawn position.

Figure 5A:
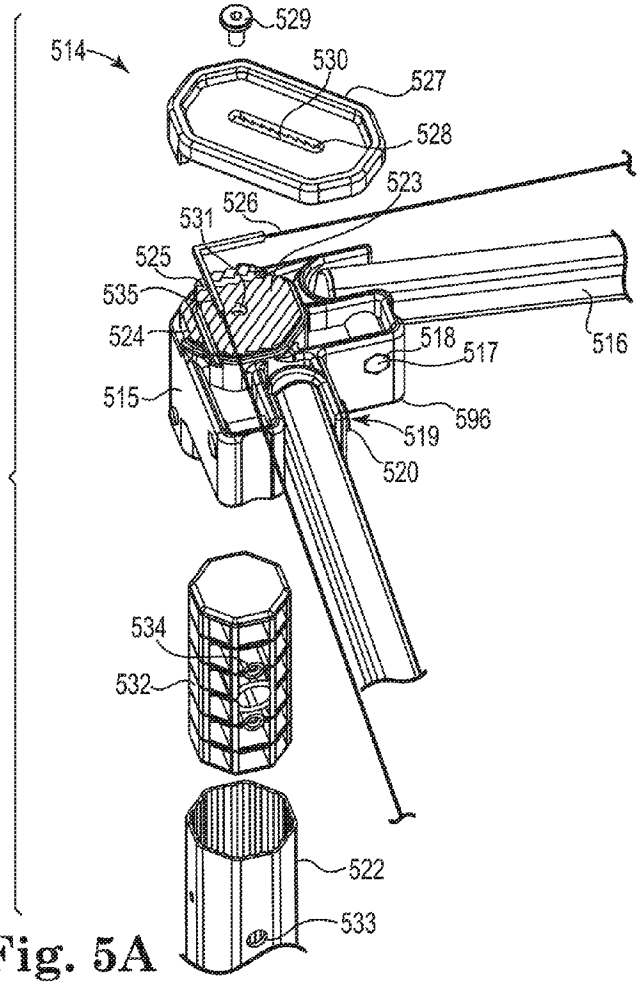
FIG. 5A is an exploded view of a mounting member of a shelter coupled to a vertical support leg including a channel configured to receive a cable according to an embodiment of the present disclosure.

FIG. 5A shows an exploded view of a corner mounting member 514. The corner mounting member 514 of FIG. 5A includes a cavity (not visible from the perspective shown in FIG. 5A) configured to receive a vertical support leg 522 having a shape corresponding to the shape of the cavity. The cavity and correspondingly shaped vertical support leg 522 can comprise any suitable shape. The embodiment of 5A is an octagonal prism shaped cavity and vertical support leg 522. A portion of the surface of the corner mounting member 514 opposite the cavity opening is a horizontal elevated ridged surface 523. Extensions of an outer peripheral wall to the elevated ridged surface 523, which also may include horizontal elevated ridged surfaces, form retaining walls 524 that extend along the outer peripheral wall beyond the solid body of the corner mounting member 514. As a result a peripheral edge of the elevated ridged surface 523 and the retaining walls 524 form a channel 525 configured to receive a cable 526.

Each corner upper terminal end of the arm members 516 of an outer peripheral truss section, e.g., 106 in FIG. 1, is secured by a corner mounting member 514. Corner mounting member 514 is preferably made up of a polypropylene compound and includes bosses 515 in the form of generally lateral projections 596 which receive hollow pivot shafts 517 having a noncircular head 518 to threadedly receive a bolt 519 having an enlarged head 520 for pivotally securing the terminal ends of the arm members 516 to the bosses 515 for pivotal movement about horizontal axes with a minimum of pressure and frictional engagement therebetween. The pivot shaft 517 which is preferably metal is inserted through an aligned bore in the arm members (not visible), and an aligned bore, hidden in this illustration by the noncircular head 518 of the pivot shaft 517, in the boss 515 until the non-circular head 518 is seated in a conforming stop or recess, hidden in this illustration by the noncircular head 518 of the pivot shaft 517. The non-circular head 518 of the shaft 517 is fixed against rotation in the conforming recess and the bolt 519 is threaded into an internally threaded end of the hollow shaft 517. This allows for greater ease of use by a user as tightening or replacing the bolt 519 requires a single wrench and one-handed operation.

FIG. 5A also illustrates an adjustable cap member 527 of the corner mounting member 514. The adjustable cap member 527 of FIG. 5A includes ridges 528 on its underside for engaging the elevated ridged surface 523 of corner mounting member 514. When the adjustable cap member 527 is placed on top of the elevated ridged surface 523 of corner mounting member 514 in a manner that the ridges 528 and 523 interlock, a fastener 529, depicted here as a bolt, may be placed through an opening 530, depicted here as rounded and oblong, present in the adjustable cap member 527 and threadedly inserted into a bore 531 threadedly configured to receive the fastener 529 in the center of the elevated ridged surface 523 of the corner mounting member 514. The result is an adjustable cap member 527 that is releasably attached to the corner mounting member 514 by both the fastener 529 and the frictional forces of the interlocking ridges 528 and 523. Since the ridges 528 and 523 may interlock while the adjustable cap member 527 is in a plurality of different positions, the rounded oblong opening 530 present in the adjustable cap member 527 of the depicted embodiment allows the adjustable cap member 527 to be attached in a plurality of different positions. As a result, the adjustable cap member 527 may extended outward from the corner mounting member 514 providing additional tension to a canopy (not shown) fitted around the corner mounting member 514. Regardless of the position in which the adjustable cap member 527 is releasably attached to the elevated ridged surface 523, the adjustable cap member 527 forms a ceiling for the channel 525 configured to receive a cable 526. FIG.

5A includes a corner fitting 535 which extends around the periphery of the cable 526 and maintains the cable 526 in a predetermined configuration, e.g., at a 90° angle.

FIG. 5A also illustrates an internal support body 532 in the inner shaft of the vertical support leg 522. The internal support body 532 can provide added support in the vertical support leg 522 to resist shearing and bending forces that are exerted on the vertical support leg 522. The internal support body 532 is located proximate to opening 533 in vertical support leg 522. Opening 533, in the depicted embodiment may be configured to receive a pin that holds a corner mounting member in place on vertical support leg 522. The area of the vertical support leg 522 around opening 533 can be subject to greater stress acting as the connection point of the peripheral truss (not fully depicted) and vertical support leg 522. The internal support body 532 can strengthen this area of the vertical support leg 522, thereby reducing the negative effects of the stress associated with opening 533. The internal support body 532 can include an opening 534 to receive the pin that holds a corner mounting member in place on vertical support leg 522. In varied embodiments, a number of internal support bodies, e.g., 532 of FIG. 5A, can be located in any portion of the vertical support legs, e.g., 522 of FIG. 5A, or truss sections, e.g., 106 and 114 of FIG. 1A. For example, a number of internal support bodies, e.g., 532 of FIG. 5A, may be located at the pivotal x-joints, e.g., 124 FIG. 1B, of truss sections, e.g., 106 and 114 of FIG. 1A, of a collapsible frame assembly, e.g, 101 of FIG. 1A.

Figure 5B:
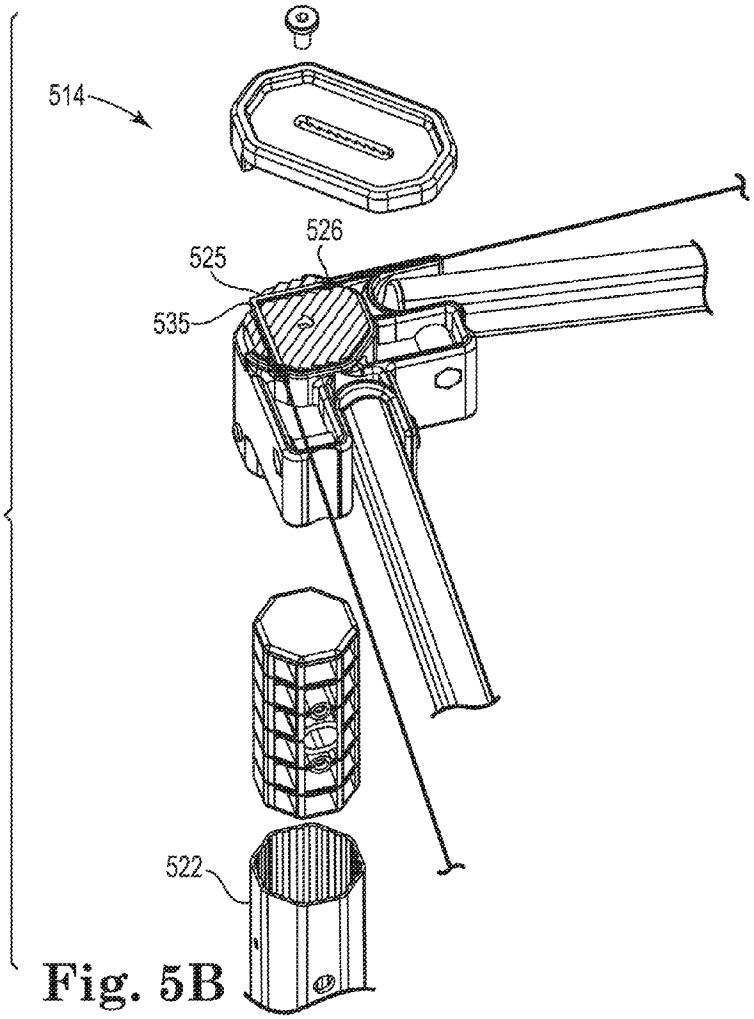
FIG. 5B is an exploded view of a mounting member of a shelter coupled to a vertical support leg having a channel with a cable seated therein according to an embodiment of the present disclosure.

FIG. 5B is an exploded view of a corner mounting member 514 of a collapsible shelter coupled to a vertical support leg 522 having a channel 525 with a cable 526 seated therein according to an embodiment of the present disclosure. In FIG. 5B, the corner fitting 535 of cable 526 is depicted engaging the channel 525 with a frictional fit.

Figure 6A:
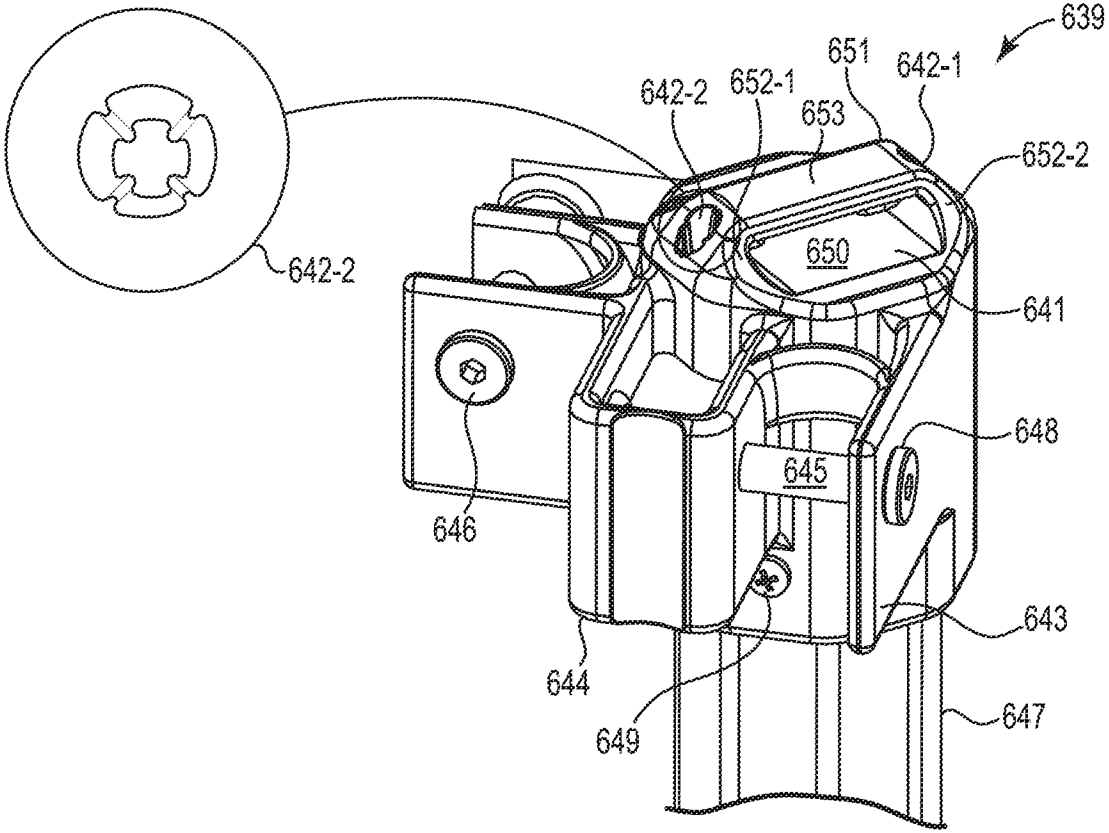
FIG. 6A is a perspective view of a mounting member of a shelter coupled to a vertical support leg having a channel configured to receive a cable and two openings configured to receive fittings of a cable according to an embodiment of the present disclosure.

FIG. 6A is a perspective view of a corner mounting member 639 of a shelter coupled to a vertical support leg 647 having a channel 641 configured to receive a cable and two openings, 642-1 and 642-2, configured to receive fittings of the cable, e.g., 526 in FIGS. 5A and 5B, according to an embodiment of the present disclosure. The corner mounting member 639 includes bosses 643 in the form of generally lateral projections 644 which receive hollow pivot shafts 645 to threadedly receive a bolt 646 having an enlarged head 648 for pivotally securing the terminal ends of the arm members (not shown) to the bosses 643 for pivotal movement about horizontal axes with a minimum of pressure and frictional engagement therebetween. The pivot shaft 645 which is preferably metal is inserted through an aligned bore in the arm members, e.g., 516 in FIG. 5A, and an aligned bore, hidden in this illustration, in the boss 643 until the non-circular head is seated in a conforming stop or recess, hidden in this illustration. The non-circular head of the shaft is fixed against rotation in the conforming recess and the bolt 646 is threaded into an internally threaded end of the hollow shaft 645. This allows for greater ease of use by a user as tightening or replacing the bolt 646 requires a single wrench and one-handed operation.

The corner mounting member 639 of FIG. 6A includes a cavity, not visible from the perspective shown in FIG. 6A, configured to receive a vertical support leg 647 having a shape corresponding to the shape of the cavity. The cavity and correspondingly shaped vertical support leg can comprise any suitable shape. The embodiment of FIG. 6A is an octagonal prism shaped cavity and vertical support leg 647. By aligning a bore (not visible from the perspective of the illustration) of the corner mounting member 639 with a bore (not visible from the perspective of the illustration) in the vertical support leg 647 and threadedly inserting a screw 649 in to the two bores until the screw head is seated upon the surface of the vertical support leg 647, attachment is achieved. In a number of embodiments, the corner mounting member 639 of FIG. 6A can include an internal support body, e.g., 532 of FIG. 5A in the inner shaft of the vertical support leg 647 to resist shearing and bending forces that are exerted on the vertical support leg 647.

In FIG. 6A, a portion of the surface of the corner mounting member 639 opposite the cavity opening is a flat surface 650. Extending above the flat surface 650 is an additional elevated surface 651 (e.g. a substantially rectangular arch), attached to the flat surface 650 by connector portions 652-1 and 652-2 (e.g. end posts comprising haunches of the substantially rectangular arch), with a substantially perpendicular flat deck surface 653 situated atop the channel 641 formed between the flat surface 650 and the additional elevated surface 651. The channel 641 is configured to receive a cable. In varied embodiments the additional elevated surface 651 has any shape which forms a channel 641 configured to receive a cable. Additional embodiments include a horizontal elevated ridged surface present on the additional elevated surface 651 engageable with ridges on the underside of an adjustable cap member of the type depicted in FIGS. 5A and 5B. The adjustable cap member may be extended outward from the corner mounting member providing additional tension to a canopy fitted around the corner mounting member as described in connection with FIGS. 5A and 5B.

The haunches 652-1 and 652-2 of the substantially additional elevated surface 651 include two openings 642-1 and 642-2 (shown in an expanded perspective view in the pop-out of FIG. 6A) which are configured to receive fittings of a cable. In a number of embodiments, these fittings are present on the termini of a cable and once received by the openings 642-1 and 642-2 cause the termini to be fixed to the corner molding. In a number of embodiments the termini of a cable are each fed through a respective opening 642-1 and 642-2 and then fittings are attached to the termini which prevent passage back through the openings 642-1 and 642-2. In a number of embodiments, fittings are already attached to the termini of a cable as it passes into the opening 642-1 and 642-2. In such embodiments the fitting is received into an opening 642-1 and 642-2 until it reaches a position from which it is prevented from withdrawal from the opening 642-1 and 642-2. In a number of embodiments, the fitting and/or an interior of the openings 642-1 and 642-2 may comprise a resilient portion which allows entry into the opening 642-1 and 642-2, but prevents withdrawal.

Figure 6B:
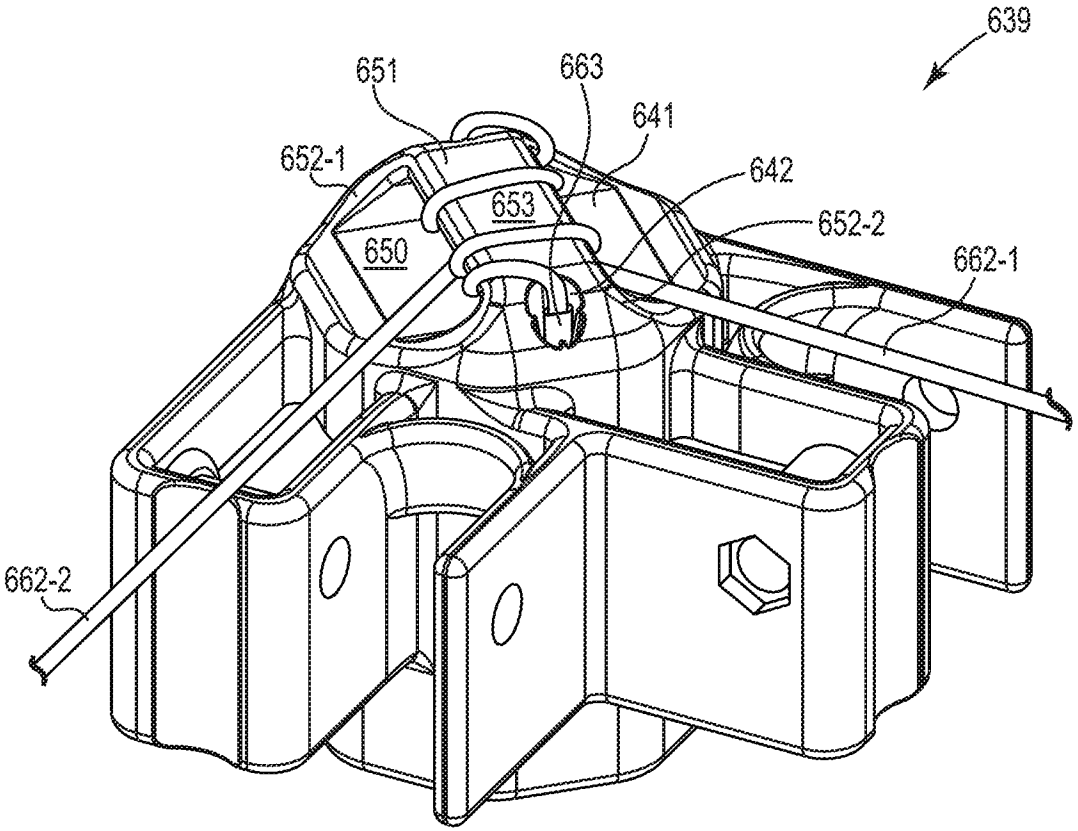
FIG. 6B is a perspective view of a mounting member of a shelter having a channel configured to receive a number of cables and cables fixed to the mounting member.

FIG. 6B is a perspective view of a corner mounting member 639 of a shelter having a channel 641 configured to receive a number of cables 662-1 and 662-2 and cables 662-1 and 662-2 fixed to the corner mounting member 639. The embodiment of FIG. 6B is one example of the manner in which the termini of a cable can be passed through the channel 641 and received by the openings 642, e.g., 642-1 and 642-2 in FIG. 6A (only one is visible from the perspective of FIG. 6B) with fittings 663, to cause the termini to be fixed to the corner molding 639. As shown in the embodiment of FIG. 6B, a number of end fittings 663 are located at the ends of the number of cables 662-1 and 662-2. The number of openings 642 (only one is visible from the perspective of FIG. 6B), can be configured to receive the end fittings 663 of the number of the number of cables 662-1 and 662-2 in a number of manners as the same has been described above in connection with FIG. 6A. A portion of the corner mounting member 639 opposite the cavity opening is a flat surface 650. Extending above the flat surface 650 is an additional elevated surface 651 (e.g. a substantially rectangular arch), attached to the flat surface 650 by connector portions haunches 652-1 and 652-2 of the substantially rectangular arch, with a substantially perpendicular flat deck surface 653 situated atop a channel 641 formed between the flat surface 650 and the additional elevated surface 651. The channel 641 is configured to receive a number of cables 662-1 and 662-2. In varied embodiments the additional elevated surface has any shape which forms a channel configured to receive a cable. Additional embodiments include a horizontal elevated ridged surface present on the additional elevated surface 651 engageable with ridges on the underside of an adjustable cap member of the type depicted in FIGS. 5A and 5B. The adjustable cap member may be extended outward from the corner mounting member providing additional tension to a canopy fitted around the corner mounting member.

The haunches 652-1 and 652-2 of the substantially additional elevated surface 651 include a number of openings 642 (only one is visible from the perspective of FIG. 6B) which are configured to receive fittings 663 of a number of cables 662-1 and 662-2. In a number of embodiments, these fittings 663 are present on the termini of a number of cables 662-1 and 662-2 and once received by the openings cause the termini to be fixed to the corner molding 639. In a number of embodiments the termini of a number of cables 662-1 and 662-2, with fittings 663 attached, are each fed through the channel 641 and then wrapped around perpendicular flat deck surface 653 situated atop a channel 641 and thereafter inserted in to respective openings 642 such that the fittings 663 prevents release from the openings 642 (only one is visible from the perspective of FIG. 6B). In such embodiments the fittings 663 are received into openings 642 (only one is visible from the perspective of FIG. 6B) until they reach a position from which the fittings 663 and attached cables 662-1 and 662-2 are prevented from withdrawal from the openings 642 (only one is visible from the perspective of FIG. 6B). In a number of embodiments, the fitting 663 and/or the interior of the openings 642 may comprise a resilient portion which allows entry into the openings 642 (only one is visible from the perspective of FIG. 6B), but prevents withdrawal. In a number of embodiments, fittings are not attached to the termini of a cable until after it passes into the opening preventing it from passing back out of the opening.

Figure 7:
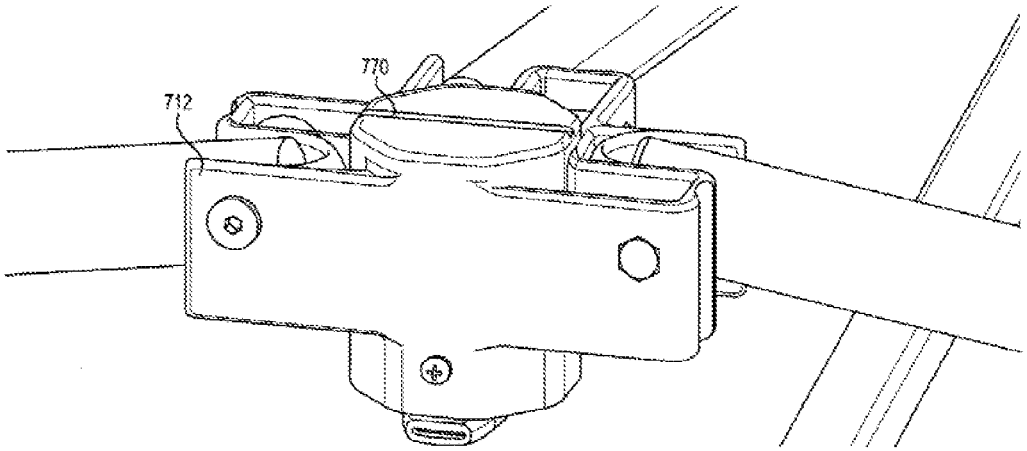
FIG. 7 is a perspective view of an intermediate mounting member of a collapsible shelter according to an embodiment of the present disclosure.

FIG. 7 is a perspective view of an intermediate mounting member of a collapsible shelter according to an embodiment of the present disclosure. FIG. 7 illustrates a magnified view offering greater detail of an intermediate mounting member 712 such as those depicted in FIG. 1A-1B (e.g., 112) and shown from a bottom exploded perspective in FIG. 3. FIG. 7 illustrates a channel 770 of the intermediate mounting member 712. The channel 770 of the intermediate mounting member 712 can be configured to receive a cable (e.g., cable 135 of FIG. 1B).

Although all embodiments have been described specifically in relation to use with a collapsible shelter, it is to be understood that the curtain system and mechanism for releasably engaging a canopy are readily adaptable for use with other types of frames.

It will be understood that when an element is referred to as being "on," "connected to" or "coupled with" another element, it can be directly on, connected, or coupled with the other element or intervening elements may be present. In contrast, when an element is referred to as being "directly on," "directly connected to" or "directly coupled with" another element, there are no intervening elements or layers present. As used herein, the term "and/or" includes any and all combinations of a number of the associated listed items.

Although specific embodiments have been illustrated and described herein, those of ordinary skill in the art will appreciate that an arrangement calculated to achieve the same results can be substituted for the specific embodiments shown. This disclosure is intended to cover adaptations or variations of a number of embodiments of the present disclosure. It is to be understood that the above description has been made in an illustrative fashion, and not a restrictive one. Combination of the above embodiments, and other embodiments not specifically described herein will be apparent to those of skill in the art upon reviewing the above description. The scope of the number of embodiments of the present disclosure includes other applications in which the above structures and methods are used. Therefore, the scope of a number of embodiments of the present disclosure should be determined with reference to the appended claims, along with the full range of equivalents to which such claims are entitled.

In the foregoing Detailed Description, some features are grouped together in a single embodiment for the purpose of streamlining the disclosure. This method of disclosure is not to be interpreted as reflecting an intention that the disclosed embodiments of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A shelter, comprising:

a number of vertical support legs;

a mounting member coupled to one of the number of vertical support legs;

a collapsible truss section interconnecting the number of vertical support legs to support a canopy; and a buckle mechanism comprising a first releasably engageable buckle body and a second releasably engageable buckle body, wherein the first releasably engageable buckle body is directly attached to an intermediate mounting assembly pivotally securing terminal ends of arm members of the collapsible truss section, and wherein the second releasably engageable buckle body is attached to the canopy.

2. The shelter of claim 1, wherein the buckle mechanism secures the canopy to the collapsible truss section in an adjustable manner.

3. The shelter of claim 1, wherein the first releasably engageable buckle body can releasably engage directly with the second releasably engageable buckle body.

4. The shelter of claim 1, including an additional buckle mechanism comprising an additional first releasably engageable buckle body and an additional second releasably engageable buckle body, wherein the additional first releasably engageable buckle body is attached to a corner mounting member attached to at least one of the vertical support legs and is configured to receive the additional second releasably engageable buckle body attached to the canopy.

5. The shelter of claim 1, wherein the first releasably engageable buckle body is releasably attached with the intermediate mounting assembly.

6. The shelter of claim 1, wherein the first releasably engageable buckle body is releasably engageable within an opening of the intermediate mounting assembly.

7. The shelter of claim 1, wherein the second releasably engageable buckle body is attached to the canopy by a strap with one terminus end sewn to the canopy.

8. The shelter of claim 7, wherein the strap has an adjustable length to provide an adjustable attachment point between the canopy and the collapsible truss section.

9. A shelter, comprising:

a number of vertical support legs;

an upper corner mounting member coupled to an uppermost end of the number of vertical support legs, wherein the upper corner mounting member includes a channel configured to receive a cable, wherein the channel is formed in an upper surface of the upper corner mounting member; and a collapsible truss section interconnecting the number of vertical support legs;

wherein the cable spans between an adjacent pair of vertical support legs around a periphery of the shelter above a bottom edge of a canopy, wherein the cable is configured to receive a releasably engageable fastener, wherein the fastener is slidable along the cable to facilitate movement of a curtain that extends below the bottom edge of the canopy.

10. The shelter of claim 9, wherein the cable is attached between an adjacent pair of corner mounting members.

11. The shelter of claim 9, wherein the cable is seated within the channel of the mounting member.

12. The shelter of claim 9, wherein the curtain includes a pair of separable curtains along a side of the shelter that can be joined in a middle of the side.

13. The shelter of claim 12, wherein the pair of separable curtains are releasably coupled with a zipper.

14. The shelter of claim 9, wherein each of a pair of separable curtains can be releasably coupled along a vertical support leg when separated.

15. The shelter of claim 14, wherein each of the pair of separable curtains includes a curtain tie back configured to gather each separable curtain at one of the number of vertical support legs.

16. A shelter, comprising:

a number of vertical support legs;

a mounting member coupled to the number of vertical support legs, wherein the mounting member includes a channel configured to receive a cable that spans between an adjacent pair of vertical support legs around a periphery of the shelter, wherein the cable is configured to receive a curtain;

a number of collapsible truss sections interconnecting the number of vertical support legs to support a canopy; and a buckle mechanism comprising a first releasably engageable body and a second releasably engageable body, wherein the first releasably engageable body is attached to the collapsible truss section and wherein the second releasably engageable body is attached to the canopy by a strap with one terminus end fixed to the canopy, and wherein the strap has an adjustable length to provide an adjustable connection between the canopy and the collapsible truss section.

17. The shelter of claim 16, wherein the cable is seated within the channel of the mounting member.

18. The shelter of claim 16, further comprising an intermediate mounting member coupled to at least one of the number of collapsible truss sections, wherein the intermediate mounting member includes a channel configured to receive the cable.

19. The shelter of claim 18, wherein the first releasably engageable body is attached to the collapsible truss section via releasable attachment with the intermediate mounting assembly.

* * * * *